US006135190A

United States Patent [19]

Gompertz et al.

[11] Patent Number: 6,135,190

[45] **Date of Patent: *Oct. 24, 2000**

[54] CHAIN BARRIER

[75] Inventors: Michael A. Gompertz, Orinda; Art B. Dawson, San Ramon, both of Calif.

[73] Assignee: IJOT Development, Inc., Oakland, Calif.

[ * ] Notice: This patent is subject to a terminal disclaimer.

[21] Appl. No.: 09/148,439

[22] Filed: Sep. 4, 1998

Related U.S. Application Data

[63] Continuation of application No. 08/489,257, Jun. 14, 1995, Pat. No. 5,871,038, which is a continuation of application No. 08/381,016, Jan. 30, 1995, abandoned, and a continuation of application No. 08/025,105, Mar. 2, 1993, abandoned.

[51] Int. Cl.[7] ..... A47H 23/00

[52] U.S. Cl. ..... 160/328; 49/34

[58] Field of Search ..... 160/328, 329, 160/327; 49/34

[56] References Cited

U.S. PATENT DOCUMENTS

| | | | |
|---|---|---|---|
| 334,801 | 1/1886 | Parrish . | |
| 760,030 | 5/1904 | Smith . | |
| 923,494 | 6/1909 | Cummings . | |
| 1,468,471 | 9/1923 | Harsen . | |
| 1,481,044 | 1/1924 | Ware . | |
| 1,529,744 | 3/1925 | Keenan . | |
| 1,642,875 | 9/1927 | Fitch et al. . | |
| 1,643,297 | 9/1927 | Fitch et al. . | |
| 1,665,157 | 4/1928 | Dahnke . | |
| 1,790,304 | 1/1931 | House . | |
| 1,987,913 | 1/1935 | Schulz | 292/264 |
| 2,170,467 | 8/1939 | Anderson | 246/126 |
| 2,298,115 | 10/1942 | Felton et al. | 24/68 |
| 2,527,866 | 10/1950 | Welch | 296/57 |
| 2,605,829 | 8/1952 | Sawyer . | |
| 2,662,571 | 12/1953 | Kessler | 151/41.76 |
| 2,827,265 | 3/1958 | McKillop . | |
| 2,919,895 | 1/1960 | Johnson | 254/78 |
| 3,022,590 | 2/1962 | Ohlhausen | 39/5 |
| 3,893,724 | 7/1975 | Reinfeld | 292/247 |
| 4,108,405 | 8/1978 | Gibson | 246/125 |
| 4,151,900 | 5/1979 | Kirwan | 188/174 |
| 4,174,119 | 11/1979 | Biles | 280/179 |
| 4,333,268 | 6/1982 | Dumbeck | 49/34 |
| 4,509,577 | 4/1985 | Priefert | 160/328 |
| 4,553,739 | 11/1985 | Baines | 256/23 |
| 5,245,787 | 9/1993 | Swenson et al. | 49/34 |
| 5,452,542 | 9/1995 | Bardwell | 49/34 |
| 5,537,778 | 7/1996 | Bardwell et al. | 49/34 |
| 5,871,038 | 2/1999 | Gompertz et al. | 160/328 |

*Primary Examiner*—David M. Purol
*Attorney, Agent, or Firm*—Medlen & Carroll, LLP

[57] ABSTRACT

A remote-controlled mechanical device is described with a winding mechanism configured for preventing backwinding. The barrier can be lowered or raised from a remote location using an accompanying remote control device. The motor and mechanics used to raise and lower the chain are modular for easy repair and replacement, and enclosed in a protective covering in order to protect them from damage or tampering. The motor can be operated by alternating current or direct current to provide the user with flexibility and allow the barrier to be operated either by direct wire to an electrical source or by one or more batteries or recharging solar cells, and used in remote places where there is no access to electrical power.

24 Claims, 8 Drawing Sheets

CHAIN BARRIER

The present application is a continuation of U.S. patent application Ser. No. 08/489,257, filed Jun. 14, 1995, now U.S. Pat. No. 5,871,038 which is a continuation of U.S. patent application Ser. No. 08/381,016, filed Jan. 30, 1995, now abandoned which is a continuation of U.S. patent application Ser. No. 08/025,105, filed Mar. 2, 1993 now abandoned.

FIELD OF THE INVENTION

This invention relates to the field of lockable chain gates and mechanical barriers which prevent passage through an opening. More specifically, this invention relates to the field of chain gates and mechanical barriers which are opened and closed by electrical motors and which can be operated with a remote control device.

BACKGROUND OF THE INVENTION

A chain gate generally stretches across a driveway, road or passageway in order to block the travel of unwanted persons or vehicular traffic onto that driveway, road or passageway. The gate is usually attached to one post on either side of the driveway or road and stretched across and hooked, and/or locked to a post on the other side of the driveway or road. In the past the chain has been stretched across the driveway manually. A person who wanted to drive their vehicle through the chain gate or a gate-like barrier would have to get out of their vehicle, unhook the chain from the fence post or gate and then drive through the gate posts or opening. To close the chain gate or gate-like barrier, the person would again have to get out of their vehicle and hook the chain back up to the post. During inclimate weather this procedure can be very demanding as a person wishing to travel through the chain gate or gate-like barrier will be exposed to the bad weather conditions both in opening and closing the gate.

An early gate of this form is presented by J. S. Fitch et al. in U.S. Pat. No. 1,643,297. The gate structure 10 as disclosed by this patent is fixedly connected to the gate post 11. This gate structure is lowered and raised manually by pulling the cable 35 which releases and engages the arm 22 with the hook 24. When the gate structure is lowered it rests on the ground between the posts so that a vehicle driving through the gate will drive over the chain.

Another gate locking device of this type is presented by Reinfeld in U.S. Pat. No. 3,893,724. The gate 4 is connected between the stationary fence post 26 and the movable fence post 24. The movable fence post 24 is locked to another stationary fence post 2 by a locking device 1. The locking device has an arm 9 which has a flexible member 10 which connects over the top of the movable fence post 24 to lock the gate in the closed position. When the gate is opened, the flexible member 10 is manually unhooked from the top of the movable fence post 24, lifted out of the ring 28 and the gate structure is then carried to the opposite side of the road or driveway thus clearing the gate from the road or driveway. When the gate is to be closed, the gate structure has to be manually carried across the road or driveway, the bottom of the fence post 27 has to be slipped into the ring 28 at the bottom, the flexible member 10 is slipped over the top of the fence post 24 and the locking device 1 is then secured in the locked position.

A solar-powered electrically controlled gate is presented by Dumbeck in U.S. Pat. No. 4,333,268. The chain 10 is fixedly connected to the post 11 and is coupled to the pivoted lever 14 which is connected to the opposite post 12. The chain 10 is raised and lowered by the two pivoted levers 14,15 and the drive motor 16. The motor has a worm drive train 17 and a pivoting gear 18. The lever 15 is moved downward to relax the chain 10 and open the gate and the lever 15 is moved upward to tighten the chain 10 and close the gate. The operation of this gate is controlled by manual operation of the corresponding switch 42,43.

What is needed is a chain gate which can be mechanically opened and closed by a user with a remote control device so that the user will not have to get out of their vehicle at any time to open or close the gate and can also open or close the gate from a long distance away, thus giving a homeowner great protection or control, where the driveway may be a great distance from their home. What is also needed is a remote control electromechanical device which has the ability to sense an obstruction to the winding up of the chain gate or gate-like barrier and the means to stop the raising of the chain-gate, reverse its direction and return to its lowered position so as to cause no damage or stoppage to any vehicle, person, animal, object or the chain gate structure itself during the winding up process, when such an obstruction is sensed. What is also needed is a way to lock the chain when it is stretched across a road or driveway so that it will not loosen when any type of weight or force is applied to it. What is still further needed is a way to enclose the mechanics of a locking chain gate, thereby protecting the mechanics and making them vandal-proof, thus providing a non-moveable barrier and security for the user of the chain gate.

SUMMARY OF THE INVENTION

A remote-controlled mechanical locking chain gate has an electrically controlled winding mechanism with a locking device to keep the chain tight and prevent the chain from loosening when pressure is applied to the chain thus putting it into a locked position. The chain gate can be lowered or raised from a remote location using an accompanying remote control device. The motor and mechanics used to raise and lower the chain are modular for easy repair and replacement, and enclosed in a protective covering in order to protect them from damage or tampering. The motor can be operated by alternating current or direct current to provide the user with flexibility and allow the gate to be operated either by direct wire to an electrical source or by one or more batteries or recharging solar cells, and used in remote places where there is no access to electrical power.

DETAILED DESCRIPTION OF THE PREFERRED EMBODIMENT

Figure 1:
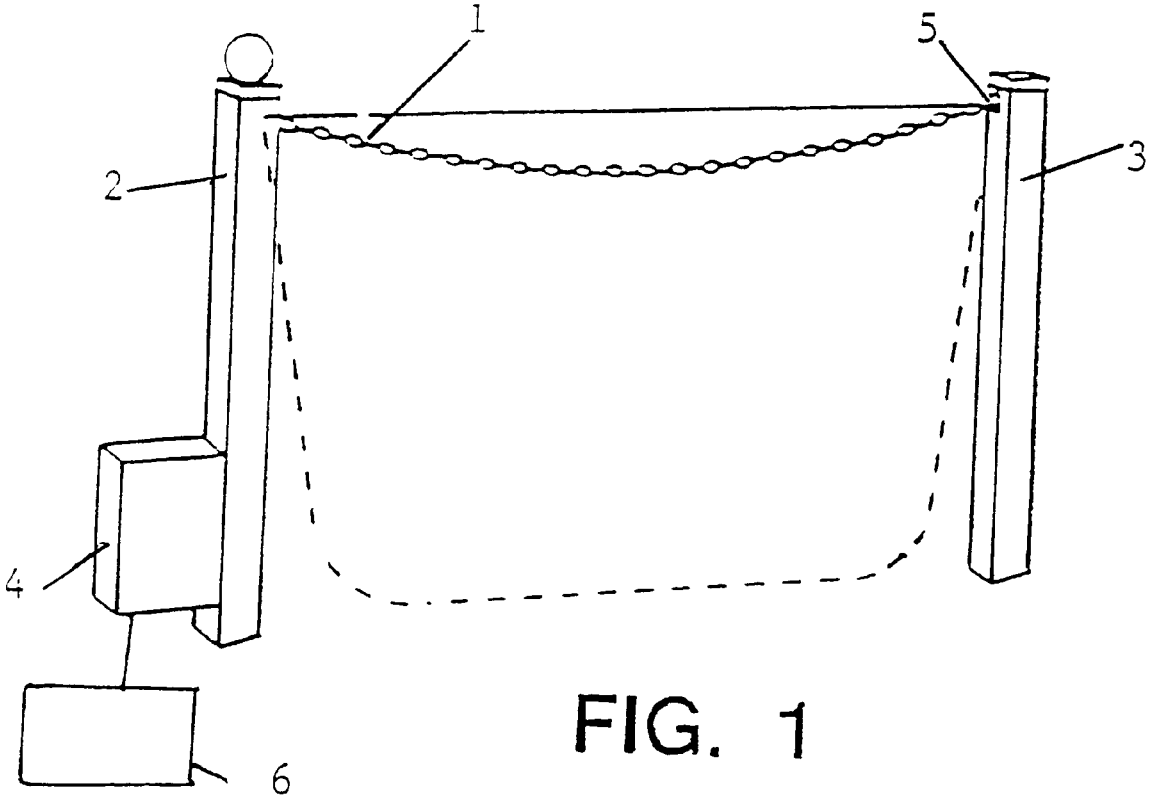
FIG. 1 illustrates one embodiment of a remote controlled mechanical chain gate.
Figure 2:
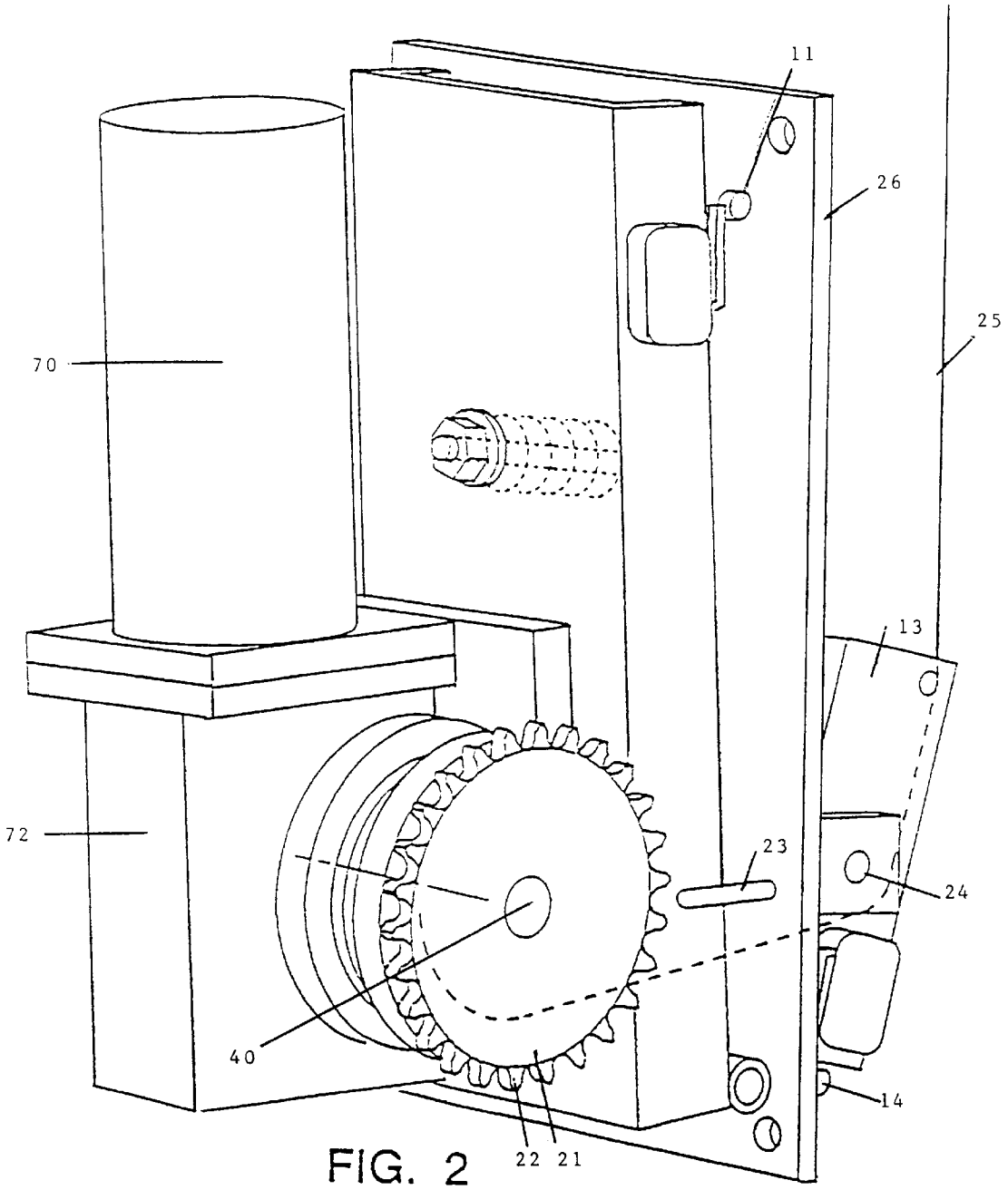
FIG. 2 illustrates a perspective view of a power drive assembly and switches.

The remote controlled mechanical chain gate as illustrated in FIG. 1 is designed to be placed across a passage way to impede travel over that passage way. The chain structure 1 is coupled to the stationary post 3 through a hole in the post or a U-bolt 5. The chain structure can be coupled to the U-bolt 5 by a padlock or some other locking device. The chain structure is also coupled to the other post 2 which is placed on the opposite side of the passageway from the stationary post 1. The protective cover 4 encloses the mechanical parts and controls which raise and lower the chain structure 1.

FIGS. 2, 3, 4 and 7 illustrate a detailed view of the power drive assembly and switches from different perspectives. The tightening cable 25, a part of the chain structure, extends through the top of the post 2 down to the pulley 24. The tightening cable 25 then goes around the pulley 24 and is coupled to the sprocket pulley 21. The sprocket pulley 21 winds the tightening cable 25 around its inner cylinder to raise the chain 1. The sprocket pulley 21 has sprocket teeth 22 around the outer edge to engage the stop-lock stud 23 and prevent the sprocket pulley from backwinding and lowering the chain structure when force is applied to the chain structure. This entire power drive assembly is a one-piece, modular unit which is held in place by four bolts for easy repair or replacement if a problem arises.

Figure 5:
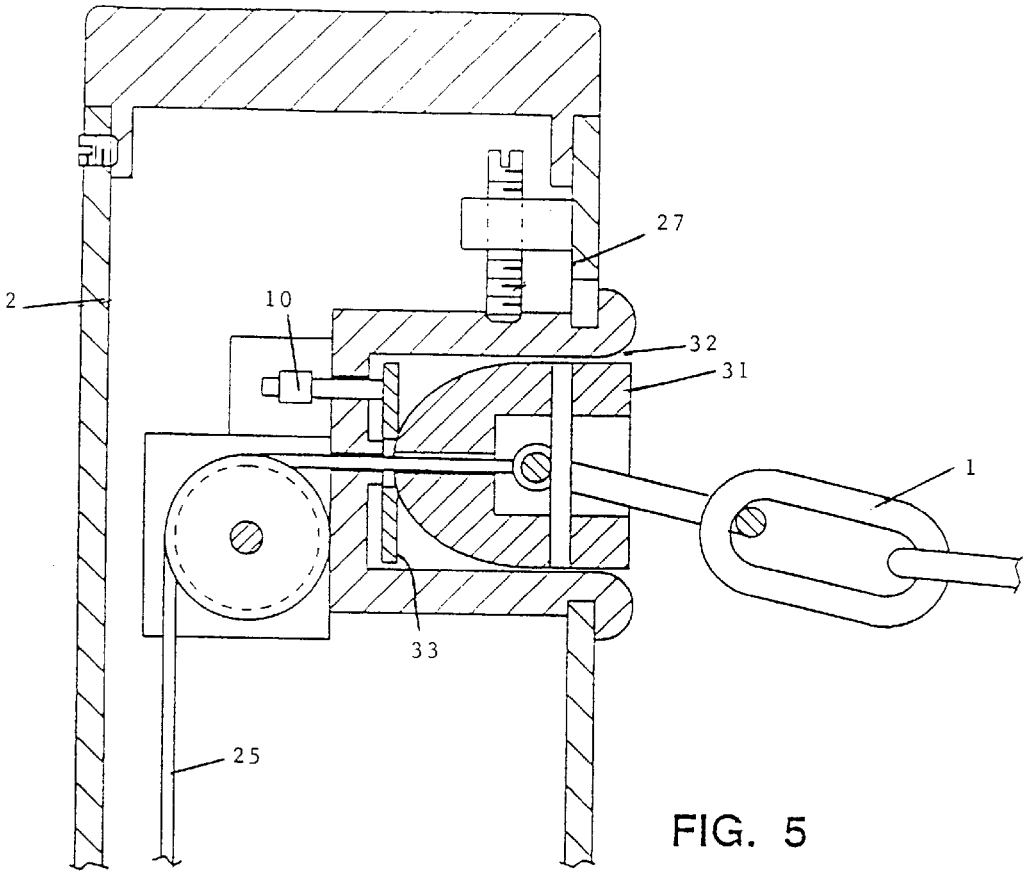
FIG. 5 illustrates the chain end insert in the raised position.
Figure 6:
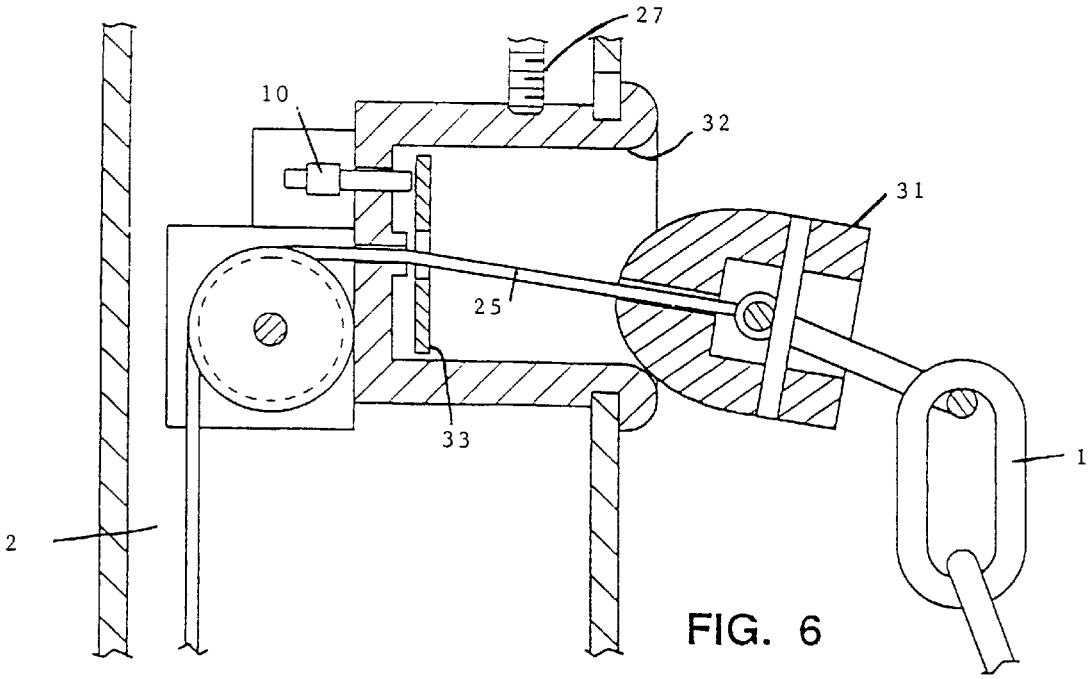
FIG. 6 illustrates the chain end insert in a loosened position.

FIGS. 5 and 6 illustrate the operation of the chain end coupler 31 which inserts into the chain guide 32. The chain end coupler 31 is coupled to the tightening cable 25 and the chain structure 1 and fits into the chain guide 32 when the chain structure 1 is in its raised and taut position. The taut switch 10 is activated by the chain end coupler 31 when it is pulled against the back of the chain guide 32. The length of the chain structure 1 can be set by the user so that the chain end insert 31 hits the sensor plate 33 at the desired tautness of the chain structure 1. The length of the chain structure 1 can be set by the user according to the length or width of the opening of the passage way with no bearing on the controls or switches. The height of the chain 1 above the ground can be set by the user, at will, by changing the part of the chain structure 1 which is coupled to the stationary pole 3 by the padlock and simply feeding the excess of the chain structure inside the stationary pole 3. Once the desired distance and height for the chain structure 1 is established, the desired tautness for the chain structure 1 will always be achieved when the chain end coupler 31 hits the sensor plate 33 in the back of the chain coupler guide 32.

Figure 8:
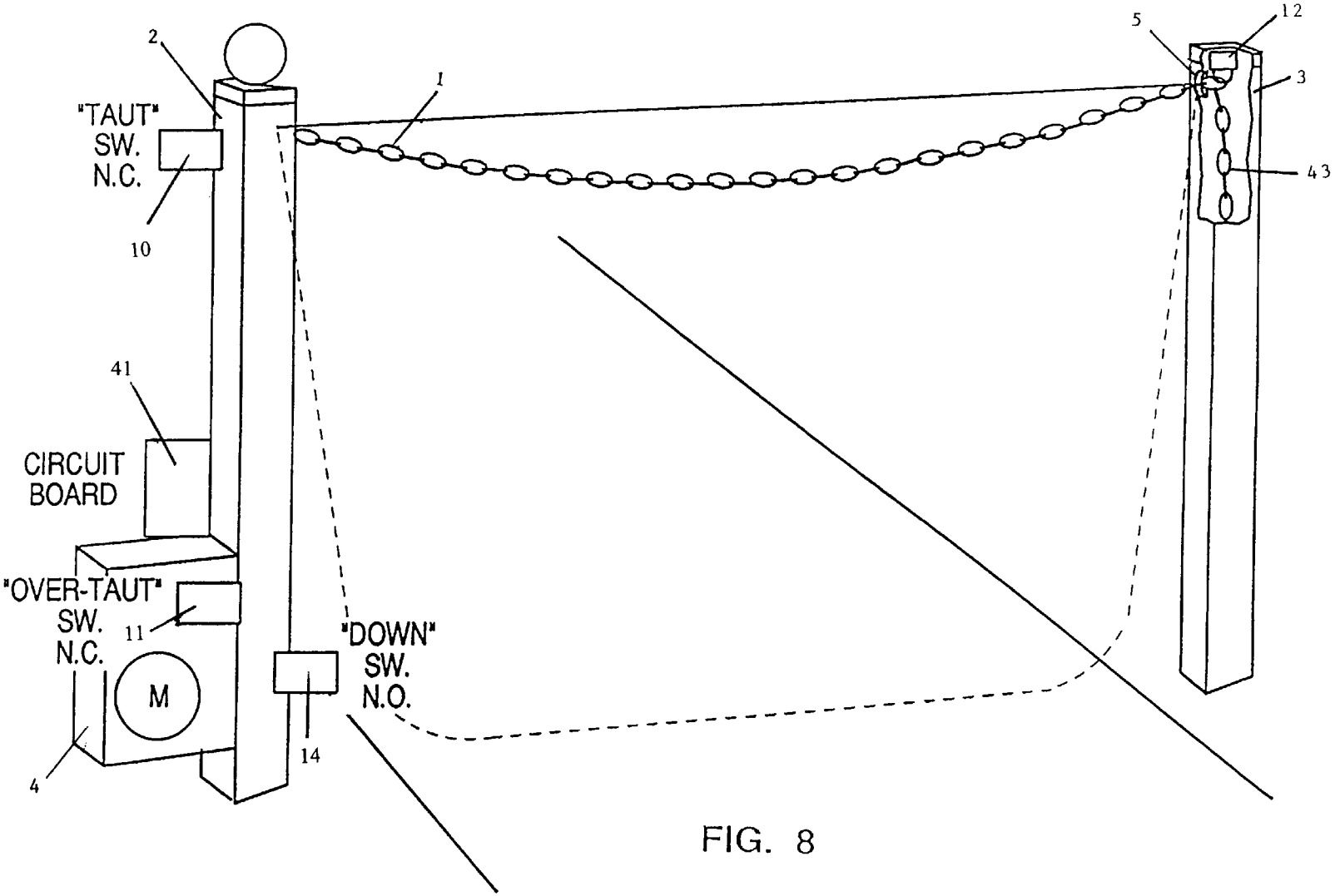
FIG. 8 illustrates the remote-controlled mechanical chain gate.

FIG. 8 illustrates the placement and function of the switches of the remote controlled mechanical chain gate mechanism. The taut switch 10 at the top of the post 2 signals when the chain is raised to its taut position. The "over-taught" switch 11 is coupled to the end of the drive plate for signalling when the chain is tightened to its maximum. The "chain-down" switch 14 is coupled to the mechanisms tension indicator arm 13 for signalling when the chain is fully extended and relaxed. The circuit board 41 is contained inside the protective cover 4 and contains the circuitry needed to receive the remote control signal and activate or deactivate the motor. This circuitry is of a conventional type and could be designed by one reasonably skilled in the art in order to control the motor and receive signals from the switches and the remote control. FIG. 8 also shows the excess chain 43 as it hangs inside the post 3.

Figure 3:
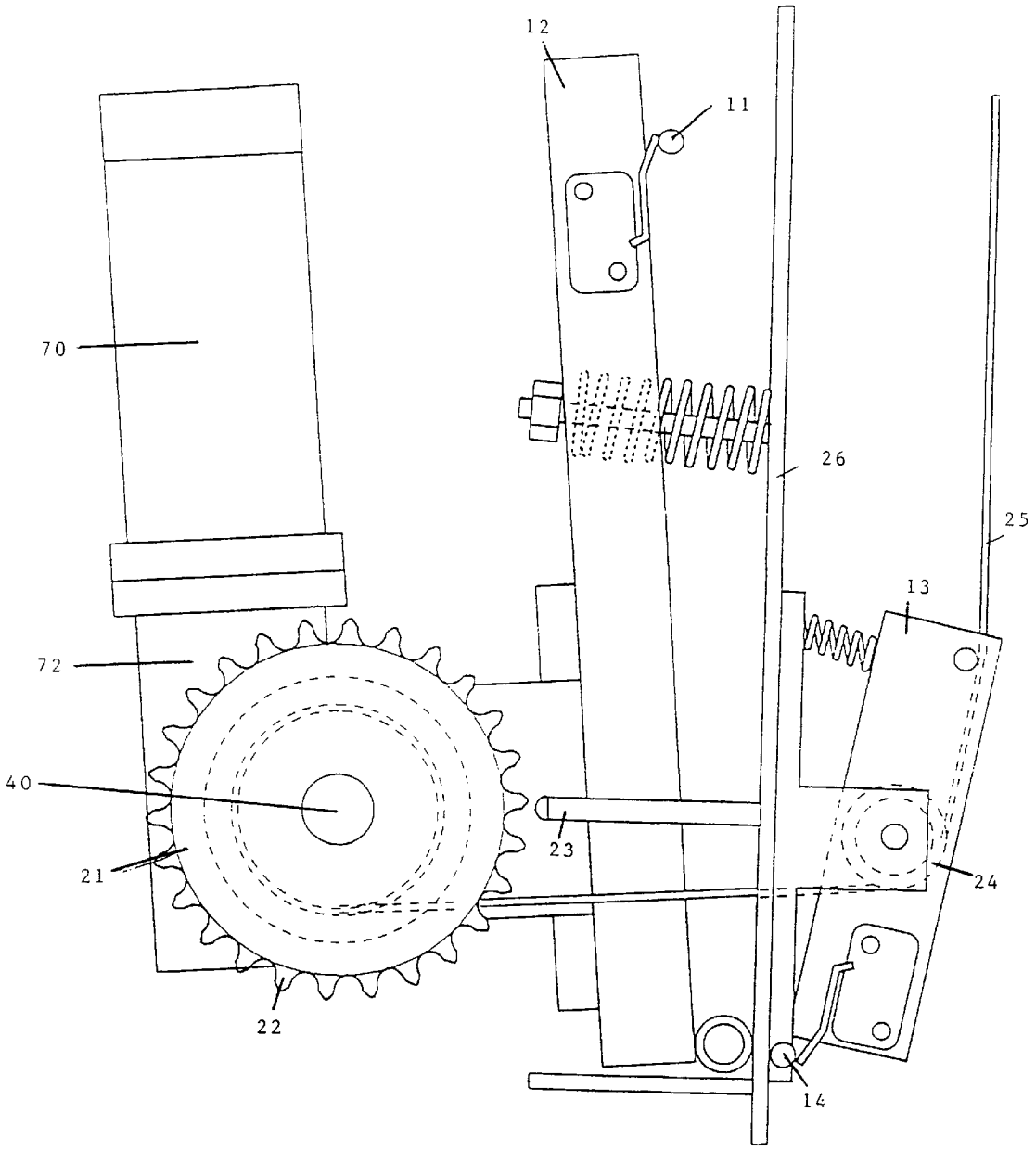
FIG. 3 illustrates a side view of the power drive assembly and switches.
Figure 4:
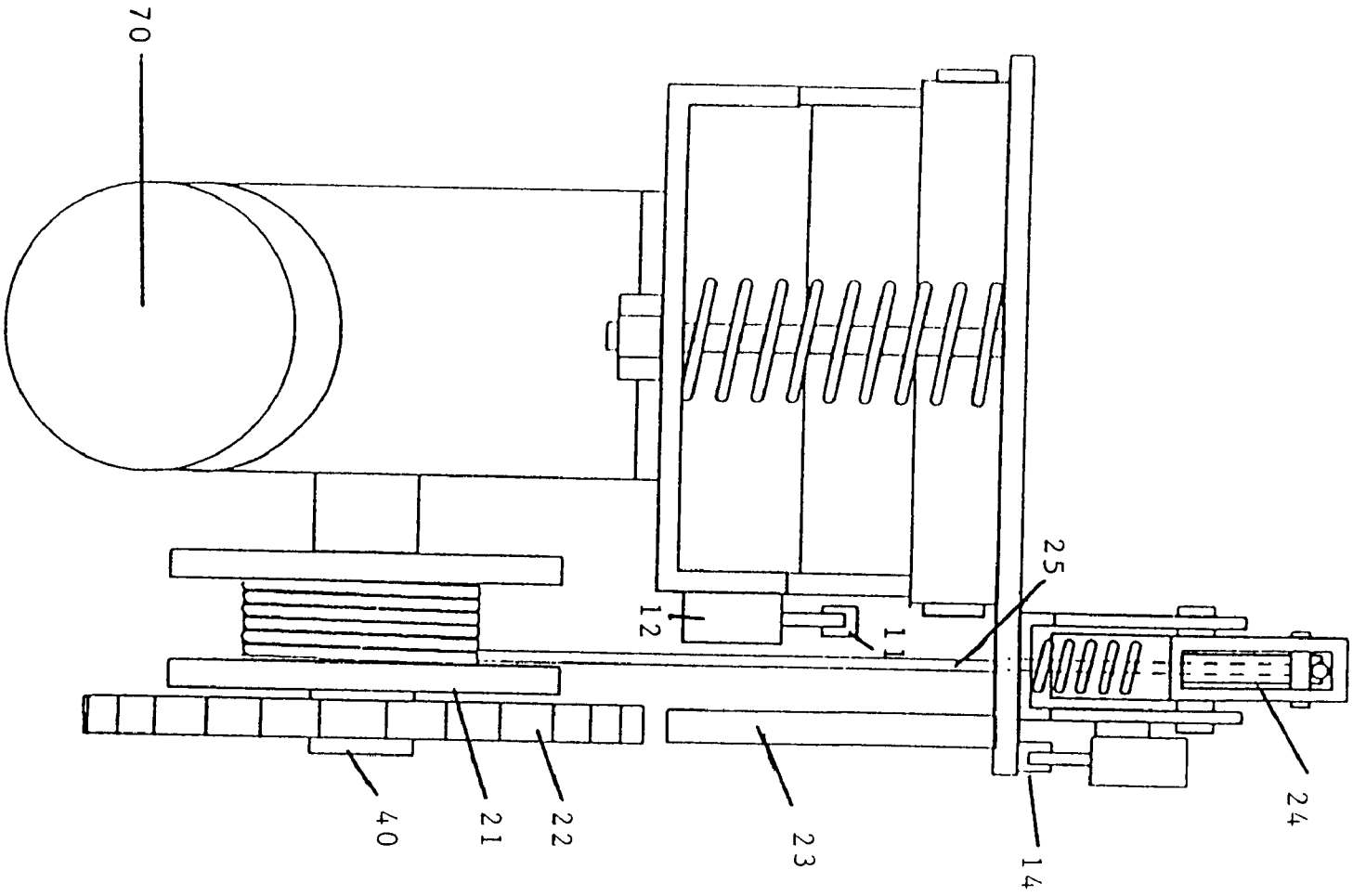
FIG. 4 illustrates a top view of the power drive assembly and switches.
Figure 7:
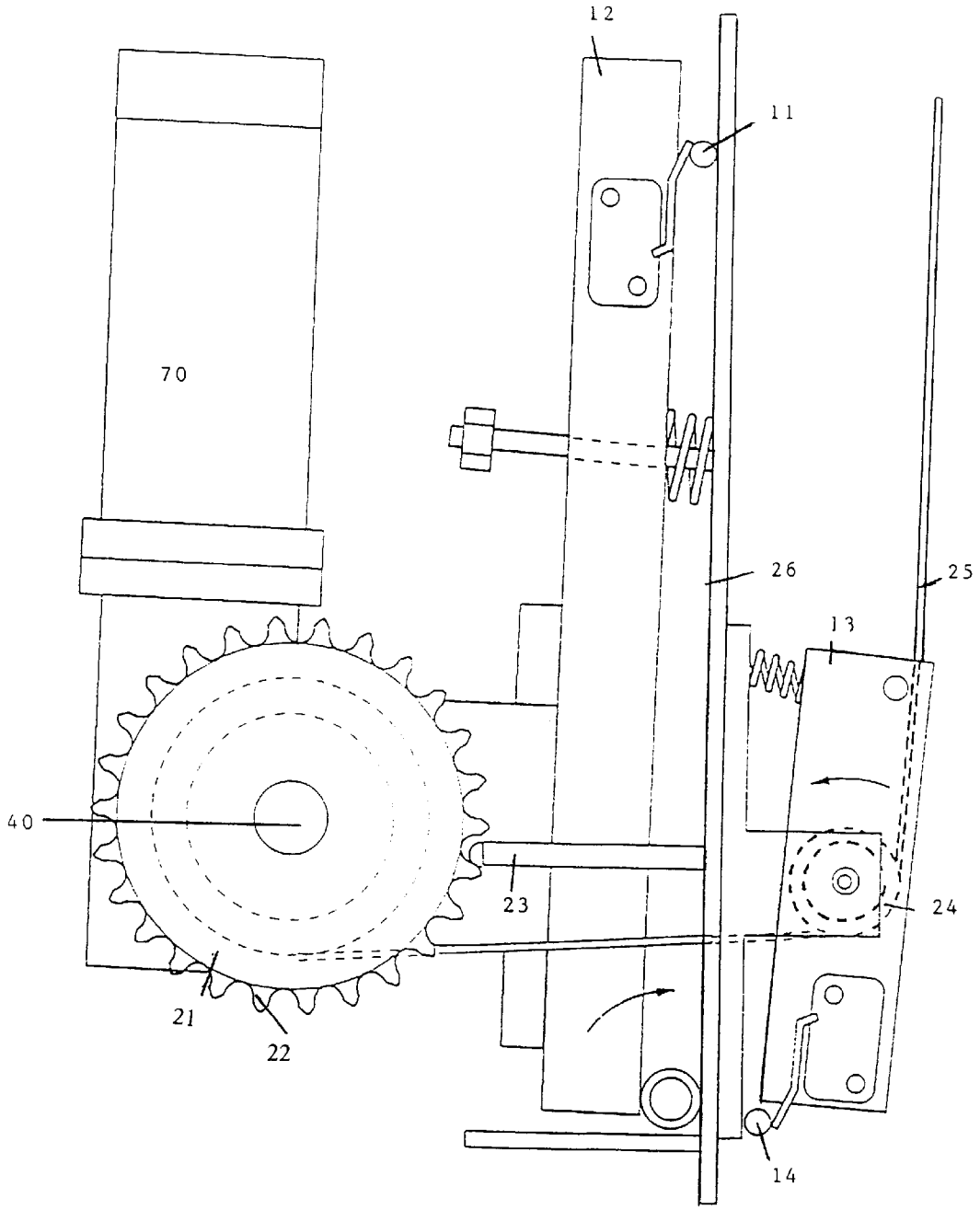
FIG. 7 illustrates a detailed side view of the power drive assembly and switches.

The chain structure 1 is raised from the lowered position when the operating button on the remote control device is pressed. The drive motor is turned on and begins to operate the drive shaft which extends from the drive motor to the gear box. The drive shaft from the gear box then turns the sprocket pulley 21 which winds up the tightening cable 25 and tightens the chain structure 1. When the chain structure 1 is tight, the taut switch 10 is activated cutting off the drive motor and causing the sprocket pulley 21 to discontinue winding up the chain structure 1. At this point the chain structure 1 is in its maximum locked position and will not release the chain for any reason until it receives a signal from the remote control device. If force is then applied to the chain structure 1, such as people sitting on the chain structure or a truck driving into the chain structure, the sprocket pulley 21 is pulled into the break lock stud 23, thereby locking the mechanism and preventing the tightening cable 25 from unwinding. FIG. 3 illustrates the power drive assembly in the raised position with the break lock stud 23 not engaging the sprocket pulley. FIG. 7 illustrates the power drive assembly after force has been applied to the chain structure 1 and the sprocket pulley 21 has been pulled into the break lock stud 23.

If any weight or force is placed upon the chain structure 1 while it is in the raised position, the sprocket pulley 21 will be pulled in the direction towards the post 2 causing the stop-lock stud 23, which is secured to the equipment plate 24, to lock into the sprocket teeth 22 of the sprocket pulley 21 and prevent the sprocket pulley 21 from backwinding. This stop-lock stud 23 serves to prevent the sprocket pulley 21 from rotating in the reverse direction and unwinding the tightened cable 25. This prevents the chain structure 1 from unwinding in the presence of the weight or force when the chain structure 1 is in the raised position.

To lower the chain structure 1 from the raised position the user must press the operating button on the remote control device. When the signal to lower the gate is received from the remote control device the drive motor will then drive the drive shafts and gear box to rotate the sprocket pulley 21 in the reverse direction and unwind the tightened cable 25. The chain structure 1 will then be lowered to the ground allowing passage through the gate or passageway, over the chain.

The chain structure 1 can embody a single chain, cable or other structure which extends between the posts on either side of the passageway. This chain is coupled to one end of a tightening cable 25, with the other end of the tightening cable 25 coupled to the sprocket pulley 21. The tightening cable 25 is a part of the chain structure 1. The tightening cable 25 is enclosed in the post 2 and is wound up on the sprocket pulley 21 when the chain structure 1 is raised.

Figure 9:
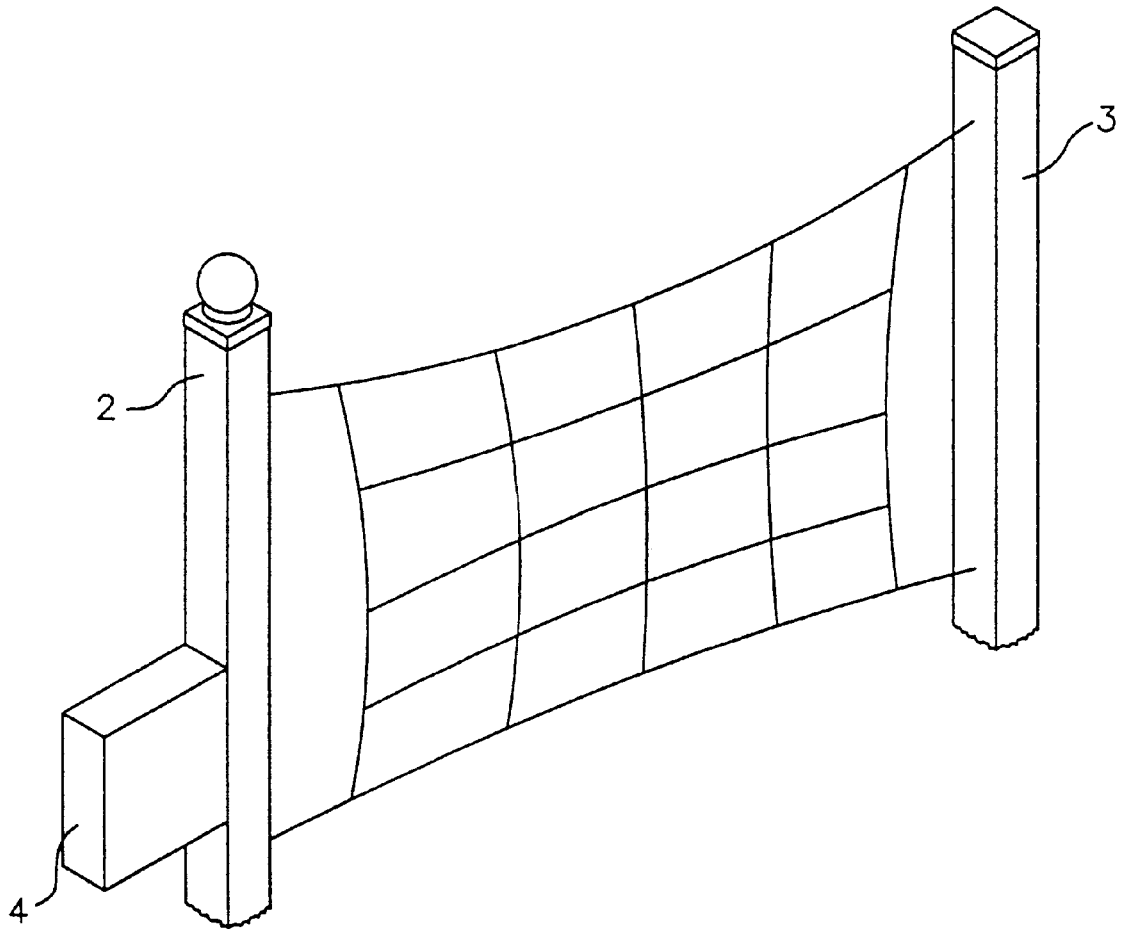
FIG. 9 illustrates an alternate embodiment of the chain structure.

The chain structure 1 can also comprise multiple chain members as illustrated in FIG. 9, which serve to further block the passageway and keep smaller objects from travelling through the gate such as cattle, small children or pets. It will be noted that in order to keep small children or pets in a fenced area the single chain or cable will not be sufficient. This chain structure has a second horizontal member which is coupled to the bottom of both posts 2,3. A plurality of vertical members are then coupled to the top chain member 1 and the bottom chain member to fill the space between the posts 2,3. Additional horizontal members can also be added to the chain structure to further block the space and add blockage support to the chain structure. These additional horizontal members would be coupled to the last vertical members on either side. Instead of vertical members, multiple diagonal members can also be used to fill the gap between the fence posts 2,3 and the top and bottom chain member. This chain structure can be made up of many different materials, including chain, cable or nylon fabric, netting, or even a solid wooden gate.

These alternative chain structures are raised and lowered in the same manner as the single chain or cable. The bottom chain member will always be coupled to the bottom of both posts 2,3 and will not move. Only the top chain member 1 will be coupled to the tightening cable 25 so that when the chain structure is raised, the top chain member 1 is pulled into a taut position at the top of the post 2, thereby pulling the rest of the structure into a raised position. When the chain structure is lowered, the tightening cable 25 is unwound and the top chain member 1 is loosened and allowed to fall to the ground. The rest of the chain structure therefore is also allowed to fall to the ground allowing access to the pathway to be accomplished by travelling over the chain structure as it lays on the ground.

An alternative embodiment of the chain structure could be a solid wooden or metal surface barricade supported on the top by the chain or cable 1 which raises and lowers that solid structure. This solid structure is also coupled to the bottom of the posts 2,3. This solid structure is raised by pulling the top of the structure up to a vertical position between the posts 2,3 and the structure is lowered by unwinding the tightening cable coupled to the top of the structure so that it will be lowered to the ground and remain in a flat, horizontal position allowing travel over the top of the wooden or metal surface barricade. The bottom of this solid structure is stationary and rotates between the horizontal and vertical positions depending on whether the structure is raised or lowered.

The drive motor can be powered by either: a direct wire linkage to 110 a.c., 220 a.c. or 240 a.c. current; a direct wire linkage to 12 or 24 volt d.c. current through a transformer which plugs into an A.C. source; or a battery which is continuously recharged by a photoelectric cell placed to receive direct sunlight or by fan blades which are placed to be rotated by the wind.

The posts 2,3 of the preferred invention can be made of numerous materials and of varying heights. The posts can be placed at any desired distance apart so that the chain gate can be used across a roadway, a walkway, an entry to a plant, subdivision or private drive or to block access to a swimming pool or any other similar use. The posts can be decorated with an ornamental or architectural designs such as heads of animals, fowls, or other design structures, which can be attached to the tops of the posts and can be changed according to the season of the year and the whim of the user. Lighting fixtures can also be attached to the top of the posts. The posts can be made out of steel, round or square, turned wood, aluminum, cast metal, concrete or any other suitable material. This chain gate structure can also be adapted to be used with existing posts, columns or other structures by drilling a horizontal hole through the post, column, wall or structure and coupling a pulley and conduit down the back side of the post into the encapsulated drive mechanism which is also coupled to the back side of the structure.

The posts 2,3 can also be equipped with an intercom which will allow a person wishing to pass through the gate to communicate with a person at a remote location having the power to raise and lower the gate. The visitor will drive up to the gate and push the intercom button or such means causing a buzzer or other means of notification to go off in the owner's house. The owner can then turn on the intercom and communicate with the visitor and decide if the chain structure should be lowered for the visitor. If the owner decides to let the visitor in, the owner can push a control button that is direct wired from the gate into the house or the owner can use the remote control to lower the gate. After the visitor passes through the gate, the owner can raise the gate again or the gate can be set to automatically raise after a set period of time has elapsed after lowering or by sensing the completion of passage through the gate. Any known sensing device can be used to sense the completion of passage through the gate.

In one embodiment of the chain gate a manual override switch can be included which will allow the user to lower the gate and pass through when there has been a power outage or the battery has completely discharged. This manual override switch can be placed inside the protective cover 4 so that it can only be accessed by unlocking the protective cover and removing it. An additional battery is also required to lower the chain gate structure 1 when the manual override switch is pressed. In the absence of the manual override switch, if there is a power failure the user can release the chain structure 1 by unlocking the padlock 42 from the stationary post 3.

The protective cover 4 fits over the drive motor and the sprocket pulley assembly to protect the mechanical parts from the weather and unwanted tampering. This protective cover 4 can be locked and secured onto the post 2. When access to the drive motor and the sprocket pulley assembly is desired for repair or upgrade this protective cover can be unlocked and disconnected from the post 2.

In an alternative embodiment the chain structure 1 can be locked in the raised position by a solenoid bolt which is coupled to the top of the post 2 and the chain guide 32. An electric charge sent from the controls will cause the solenoid to push a bolt through one side of the chain guide 32, through the chain end coupler 31 and through the other side of the chain guide 32 thus locking the chain structure in the raised position. When the chain structure 1 is to be lowered a charge is sent which causes the solenoid to pull the bolt back through the chain guide 32 and the chain end coupler 31, releasing the chain structure 1 and allowing it to be lowered.

Various modifications may be made to the preferred embodiment of the present invention without departing from the spirit and scope of the invention as defined by the appended claims.

What is claimed is:

1. An automatic electrically operated mechanical barrier system comprising:

a. a first stationary object;

b. a barrier coupled to the first stationary object and to a second stationary object;

c. means for mechanically raising and lowering the barrier, said means coupled to the first stationary object; and d. means for locking the barrier in a taut, raised position which will remain locked when weight or force is applied, said means for locking coupled to the means for mechanically raising and lowering the flexible barrier.

2. The automatic electrically operated barrier system as claimed in claim 1 wherein the means for mechanically raising and lowering the barrier is electrically powered by a direct wire linkage to an alternating current source.

3. The automatic electrically operated barrier system as claimed in claim 1 wherein the means for mechanically raising and lowering the barrier is electrically powered by a battery.

4. The automatic electrically operated barrier system as claimed in claim 1 wherein the barrier is a flexible barrier which hangs between the first stationary object and the second stationary object.

5. The automatic electrically operated barrier system as claimed in claim 1 wherein the barrier is comprised of a structure which hangs between the first stationary object and the second stationary object, the structure comprising:

a. a first horizontal member coupled to both the first stationary object and the second stationary object at a ground level;

b. a second horizontal member coupled to the first stationary object, the second stationary object, and the means for mechanically raising and lowering the barrier; and c. a plurality of flexible members coupled between the first horizontal member and the second horizontal member to block a space between the first stationary object, the second stationary object, the first horizontal member, and the second horizontal member.

6. The automatic electrically operated barrier system as claimed in claim 1 wherein the flexible barrier is coupled to a device for activating a switch and turning off the means for mechanically raising and lowering the barrier when the barrier is raised to a taut position.

7. The automatic electrically operated barrier system as claimed in claim 1 wherein the means for mechanically raising and lowering the flexible barrier can be operated by a user from a remote location using a remote-control device.

8. The automatic electrically operated barrier system as claimed in claim 1 wherein the means for mechanically raising and lowering the flexible barrier comprises:

a. a means for spooling the flexible barrier in and out, coupled to the first stationary object; and b. a rotary transmission means, coupled to the means for spooling, for rotating the means for spooling.

9. A mechanical barrier system comprising:

a. a barrier linking a first stationary object to a second stationary object;

b. means for mechanically raising and lowering said barrier, said means coupled to said barrier and comprising a power drive assembly comprising a drive motor coupled to a winding mechanism, said winding mechanism coupled to a means for preventing said winding mechanism from backwinding.

10. The barrier system of claim 9 wherein said means for mechanically raising and lowering said barrier is enclosed.

11. The barrier system of claim 9 wherein said means for mechanically raising and lowering said barrier is electrically powered by a direct wire linkage to an alternating current source.

12. The barrier system of claim 9 wherein said means for mechanically raising and lowering the barrier is electrically powered by a battery.

13. The barrier system of claim 9 wherein said barrier is a flexible barrier which hangs between said first stationary object and said second stationary object.

14. A mechanical barrier system comprising:

a. a barrier linking a first stationary object to a second stationary object;

b. means for mechanically raising and lowering said barrier, said means coupled to said barrier and contained within said first stationary object and comprising a power drive assembly comprising a drive motor coupled to a winding mechanism, said winding mechanism coupled to a means for preventing said winding mechanism from backwinding.

15. The barrier system of claim 14 wherein said first stationary object is a post.

16. The barrier system of claim 14 wherein the barrier is a flexible barrier which hangs between the first stationary object and the second stationary object.

17. The barrier of claim 14 wherein the means for raising and lowering can both be operated from a remote location by a remote-control device.

18. The barrier of claim 14 wherein the means for raising and lowering can both be powered by either alternating current or direct current.

19. The barrier system of claim 14, wherein said barrier prevents access to a passageway.

20. A mechanical barrier system comprising:

a. a power drive assembly comprising a drive motor coupled to a winding mechanism, said winding mechanism configured to prevent said winding mechanism from backwinding; and b. a barrier coupled to said power drive assembly such that said barrier can be raised and lowered, said barrier linking a first stationary object to a second stationary object.

21. The barrier system of claim 20, wherein said first stationary object is a post.

22. The barrier system of claim 20, wherein the barrier is a flexible barrier which hangs between the first stationary object and the second stationary object.

23. The barrier system of claim 20, wherein said power drive assembly can be operated from a remote location by a remote-control device.

24. The barrier system of claim 20, wherein the power drive assembly is powered by either alternating current or direct current.

* * * * *